US007390971B2

(12) United States Patent
Jean et al.

(10) Patent No.: US 7,390,971 B2
(45) Date of Patent: Jun. 24, 2008

(54) UNSHEILDED TWISTED PAIR CABLE AND METHOD FOR MANUFACTURING THE SAME

(75) Inventors: Frédéric Jean, Litiz, PA (US); Donald Stevens, Lancaster, PA (US)

(73) Assignee: Nexans (FR)

( * ) Notice: Subject to any disclaimer, the term of this patent is extended or adjusted under 35 U.S.C. 154(b) by 0 days.

(21) Appl. No.: 11/119,331

(22) Filed: Apr. 29, 2005

(65) Prior Publication Data

US 2006/0243477 A1 Nov. 2, 2006

(51) Int. Cl.
*H01B 7/00* (2006.01)

(52) U.S. Cl. ..... 174/113 AS; 174/113 R; 174/113 C

(58) Field of Classification Search ..... 174/113 AS, 174/113 C, 113 R
See application file for complete search history.

(56) References Cited

U.S. PATENT DOCUMENTS

| | | | | |
|---|---|---|---|---|
| 5,796,046 | A | 8/1998 | Newmoyer et al. | 174/113 |
| 5,922,155 | A | 7/1999 | Clouet et al. | 156/51 |
| 6,310,295 | B1 * | 10/2001 | Despard | 174/113 R |
| 6,596,944 | B1 | 7/2003 | Clark et al. | 174/113 |
| 6,826,338 | B2 * | 11/2004 | Matsuyama | 385/110 |
| 2003/0132021 | A1 | 7/2003 | Gareis | 174/113 |
| 2004/0124000 | A1 | 7/2004 | Stipes et al. | 174/113 |
| 2005/0006132 | A1 | 1/2005 | Clark | 174/113 |
| 2005/0092514 | A1 | 5/2005 | Kenny et al. | 174/113 |
| 2005/0092515 | A1 | 5/2005 | Kenny et al. | 174/113 |
| 2005/0279528 | A1 | 12/2005 | Kenny et al. | 174/113 |
| 2006/0237217 | A1 | 10/2006 | Glew | 174/113 |

FOREIGN PATENT DOCUMENTS

| | | | |
|---|---|---|---|
| EP | 0688024 | 12/1995 | |
| EP | 1107262 | 6/2001 | 11/8 |
| EP | 1162632 | 12/2001 | 11/4 |
| JP | 2003323821 | 11/2003 | 11/4 |
| JP | 2003346569 | 12/2003 | 11/8 |
| WO | WO01/29848 | 4/2001 | 7/18 |
| WO | 2006050612 | 11/2005 | |
| WO | 2006065414 | 11/2005 | |

* cited by examiner

*Primary Examiner*—Jinhee J. Lee
(74) *Attorney, Agent, or Firm*—Sofer & Haran, LLP

(57) ABSTRACT

An unshielded twisted pair cable includes a plurality of unshielded twisted pairs, a filament helically wound around the plurality of unshielded twisted pairs and a jacket encasing the plurality of unshielded twisted pairs and the filament. A gap, between the jacket and the plurality of unshielded twisted pairs, is formed by and is substantially the same thickness as the thickness of the filament.

12 Claims, 7 Drawing Sheets

UNSHEILDED TWISTED PAIR CABLE AND METHOD FOR MANUFACTURING THE SAME

FIELD OF THE INVENTION

The present invention relates to an improved unshielded twisted pair cable. More particularly, the present invention relates to an improved unshielded twisted pair cable that reduces undesired crosstalk.

BACKGROUND OF THE INVENTION

In the communication industry, one type of common communication cable is formed from a pair of two wires twisted around one another, commonly referred to as a twisted pair. Typical high speed communication cables are comprised of a number of unshielded twisted pairs running through an outer jacket.

One problem that typically confronts the installation of such cables is that undesired capacitive and inductive coupling, also known as crosstalk, can occur between an unshielded twisted pair in a first cable with other items outside the cable, in particular with unshielded twisted pairs running in adjacent cables.

In order to reduce these unwanted conditions, prior art methods have introduced a number of changes into the cables, all with various degrees of satisfaction. For example, a first method used to reduce coupling with twisted pairs in adjacent cables is to increase the rate of twist between the conductors in the twisted pairs. However, by increasing the rate of twisting, the amounts of material used is greater per unit of distance, thus increasing the weight of the twisted pair, and the cable as well, and also leading to a greater amount of conductor losses in the signal due to the additional distance needed to be traversed.

A second method for addressing the condition of coupling with unshielded twisted pairs in adjacent cables is to simply increase the distance between them. In the prior art, this is done simply by increasing the thickness of the jacket. However, this presents a number of additional problems, all of which render the cable unfit.

For example, the additional material used for the jacket requires that more material be used. This additional material adds construction cost, adds weight to the final cable and also adds more fuel in the case of a fire, thus reducing or eliminating the ability of the cable to meet the required fire safety standards.

In addition to these basic physical constraints to simply adding more material to the jacket in order to prevent coupling with unshielded twisted pairs in adjacent cables, another drawback is that it will increase the amount of dielectric loss. This is particularly true with cables that include twisted pairs surrounded by a PVC jacket which is widely used for cable jacketing because of its low cost and fire resistant properties. Although PVC is commonly used for the above reasons, its poor dielectric properties also lead to increased loss in the unshielded twisted pairs. Thus, this condition is exacerbated when the jacket is made even thicker.

Another prior art solution was to place the jacket of the cable onto the twisted pairs in a loose fitting arrangement. Such a design, both increases the distance between the twisted pairs and outside interference sources and also reduces the amount of capacitive coupling, both of which are accomplished while maintaining the same amount of jacket material. However, this solution is inadequate because the loose fitting arrangement of the jacket allows the internal twisted pairs to vary their proximity to the jacket along the distance of the cable. This causes impedance variations along the length of cable as the internal twisted pairs move into and out of contact with the jacket.

Yet another solution, such as that proposed in U.S. Pat. No. 5,796,046, proposes an arrangement to add striations to the internal diameter of the jacket in order to generate a continuous and evenly spaced gap between the unshielded twisted pairs in the center and the bulk of the outer jacket. However, this design may suffer from a few drawbacks. First, by adding the striations, additional material is again included, adding weight, cost and reduced efficiency in meeting fire safety standards. Additionally, because the striations include a significant amount of material in and of themselves, having numerous contact points with the twisted pairs, there is still a significant amount of dielectric loss caused by the jacket.

In spite of past attempts to solve the problem of reducing coupling between unshielded twisted pairs in adjacent cables, there is still no low cost, light weight solution that also meets the necessary fire safety standards.

OBJECTS AND SUMMARY OF THE INVENTION

The present invention looks to address undesired capacitive and inductive coupling, also known as crosstalk, between an unshielded twisted pair in a first cable with other items outside the cable, in particular unshielded twisted pairs running in adjacent cables and to overcome the drawbacks associated with the prior art, by providing a low cost, light weight solution to address the need to reduce dielectric and dissipation losses between the internal twisted pairs and the outer jacket material of the cable.

In a first embodiment, the present invention provides an unshielded twisted pair cable having a plurality of unshielded twisted pairs, a filament helically wound around the plurality of unshielded twisted pairs and a jacket encasing the plurality of unshielded twisted pairs and the filament. A gap is disposed between the jacket and the plurality of unshielded twisted pairs, where the gap is formed by and is substantially the same thickness as the thickness of the filament.

In addition to reducing the problems outlined above with regards to dielectric and dissipation losses with the jacket, in accordance with another embodiment of the invention, a cable arrangement is provided with reduced crosstalk among the different sets of twisted pairs within the cable itself. In this arrangement an unshielded twisted pair cable is provided having a plurality of unshielded twisted pairs and a bumpered cross filler disposed within the plurality of unshielded twisted pairs. The bumpered cross filler has at least one axis for separating the unshielded twisted pairs from one another and at least one bumper element at the end of the axis. A jacket encases the plurality of unshielded twisted pairs and the bumpered cross filler. A gap is disposed between the jacket and the plurality of unshielded twisted pairs, where the gap is formed by and is substantially the same thickness as the thickness of the bumper element.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof may best be understood by reference to the following detailed description when read with the accompanying drawings in which:

DETAILED DESCRIPTION

Figure 1:
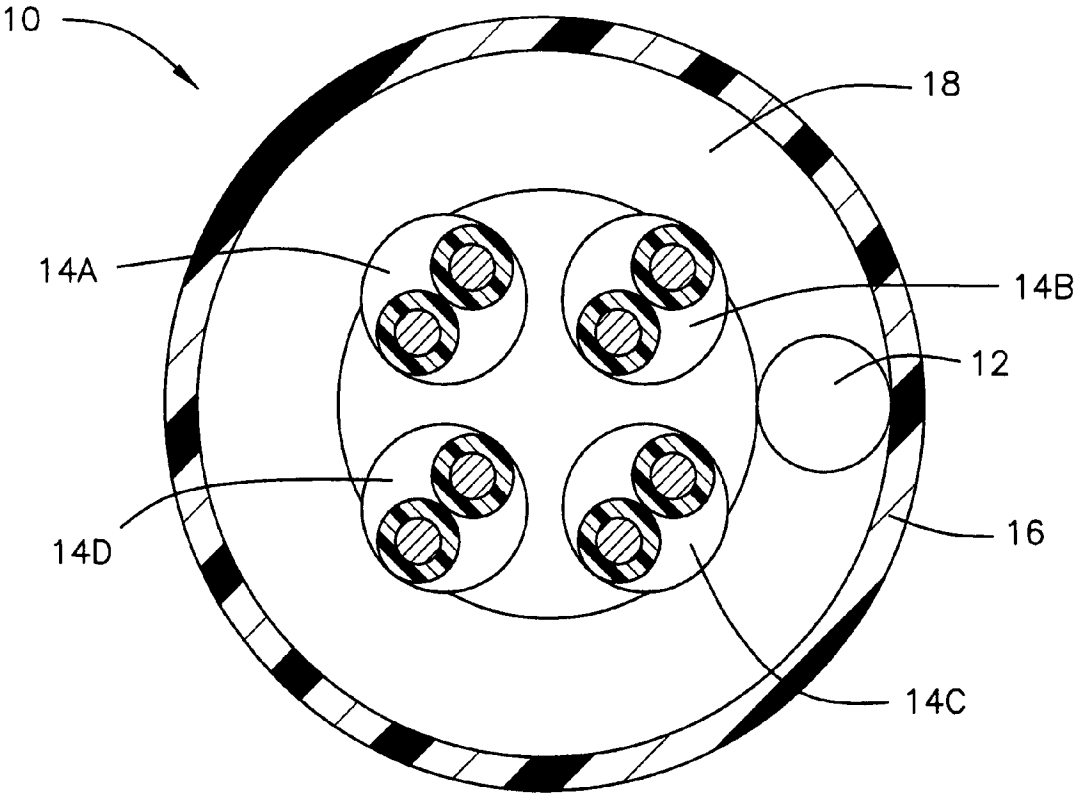
FIG. 1 is a cross sectional view of the unshielded twisted pair cable, in accordance with one embodiment of the present invention.
Figure 2:
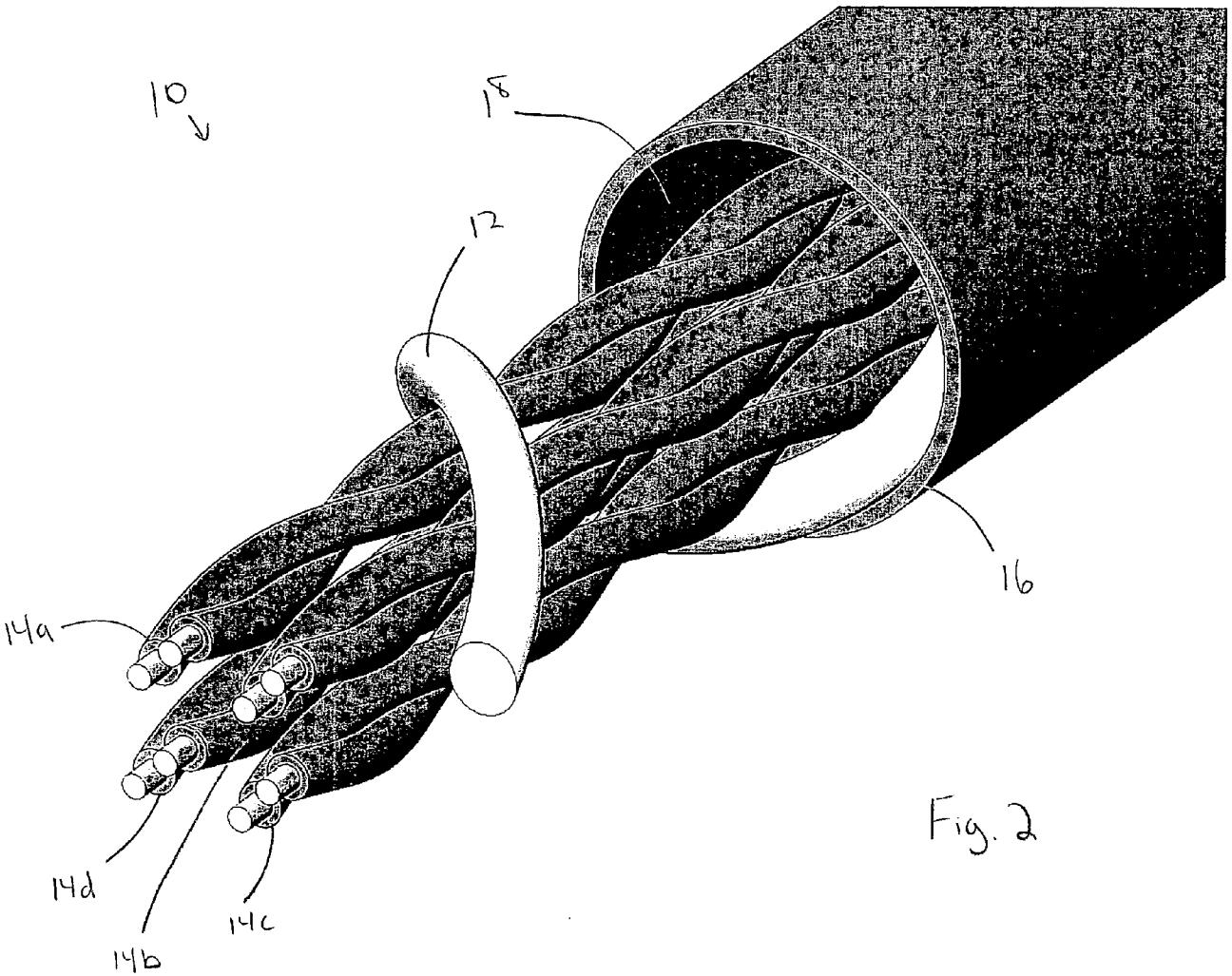
FIG. 2 is an isometric view of an unshielded twisted pair cable from FIG. 1 with the portion of the jacket removed, in accordance with one embodiment of the present invention.

As illustrated in FIGS. 1 and 2, the present invention provides for an unshielded twisted pair cable 10. Cable 10 preferably includes an outer jacket 16, a number of twisted pair conductors 14*a* . . . 14*n* and a spacing filament 12. Twisted pairs 14 refer to typical unshielded twisted pair conductors used for data communications which includes high frequency signals. As illustrated in FIGS. 1 and 2, there are four twisted pairs 14*a*-14*d*, however, this is by way of illustration only. Any number of twisted pairs 14 used within a similar cable 10 arrangement is within the contemplation of the present invention.

For the purposes of illustration, twisted pairs 14 will be discussed through the application as copper conductor pairs with FEP (Fluorinated Ethylene Propylene) insulation, however this is in no way intended to limit the scope of the present invention. For example, twisted pairs 14 may also include, but is not limited to copper conductors with MFA (Polytetrafluoroethylene-Perfluoromethylvinylether) insulation, stranded conductors made of tined plated copper, silver plated or bare copper strands with PE (polyethylene) insulation, copper conductors with PE insulation, copper conductors with cellular PE or FEP insulation, or copper conductors with cellular PE or FEP insulation and an outer PE or FEP skin (solid layer).

Outer jacket 16 is preferably constructed of a polymer such as PVC (Polyvinyl chloride) because of its low cost and fire resistance characteristics. Although, other similar suitable materials may be used for jacket 16, for the purposes of illustration, the present invention is described using PVC for jacket 16. Other such compounds that used for jacket 16 may include but are not limited to: low smoke zero halogen PVC, FEP, PVDF (Polyvinylidene Fluoride), PE or ECTFE (Poly (Ethylene Chlorotrifluoroethylene)).

As illustrated in FIGS. 1 and 2, twisted pairs 14*a*-14*d* are disposed centrally within outer jacket 16 of cable 10, with an air spacing pocket 18 between the two. Air spacing pocket 18 is formed by filament 12 disposed helically around the center core of twisted pairs 14 holding jacket 16 at a predefined distance substantially equal to the thickness of filament 12.

Figure 3:
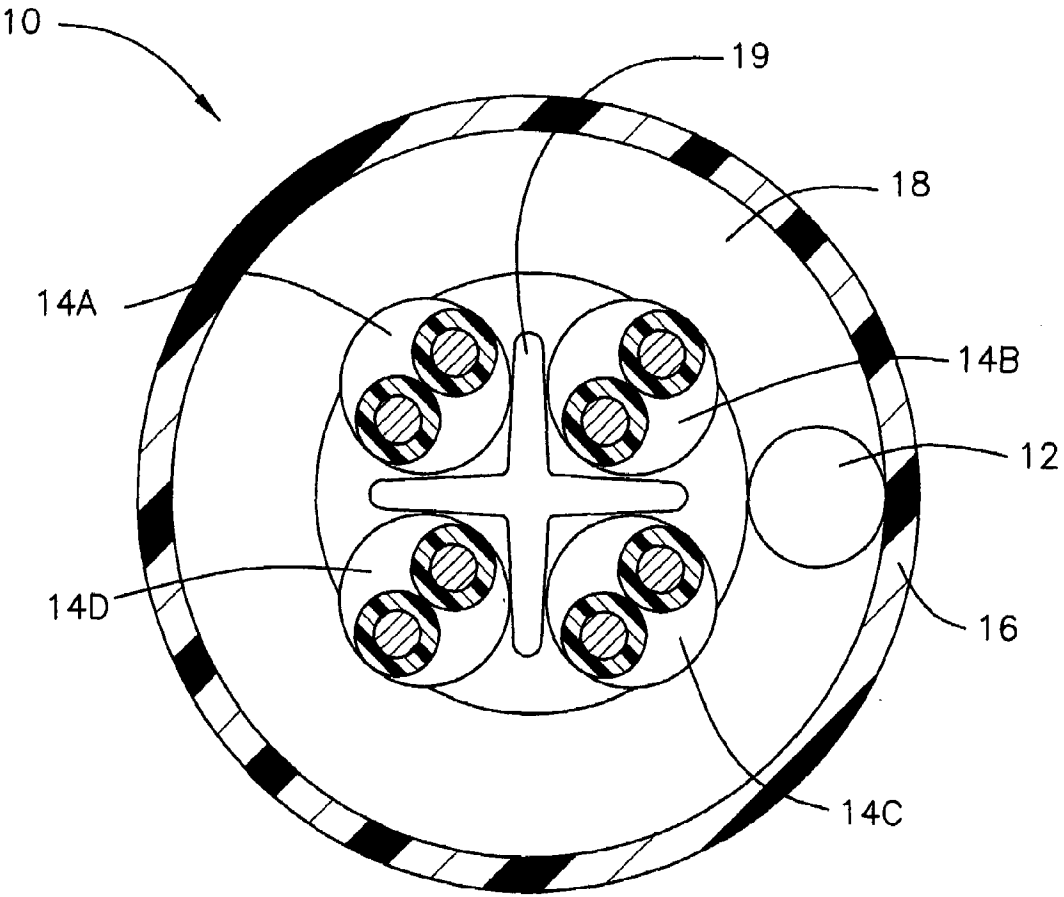
FIG. 3 is a cross sectional view of the unshielded twisted pair cable having a cross filler, in accordance with one embodiment of the present invention.
Figure 4:
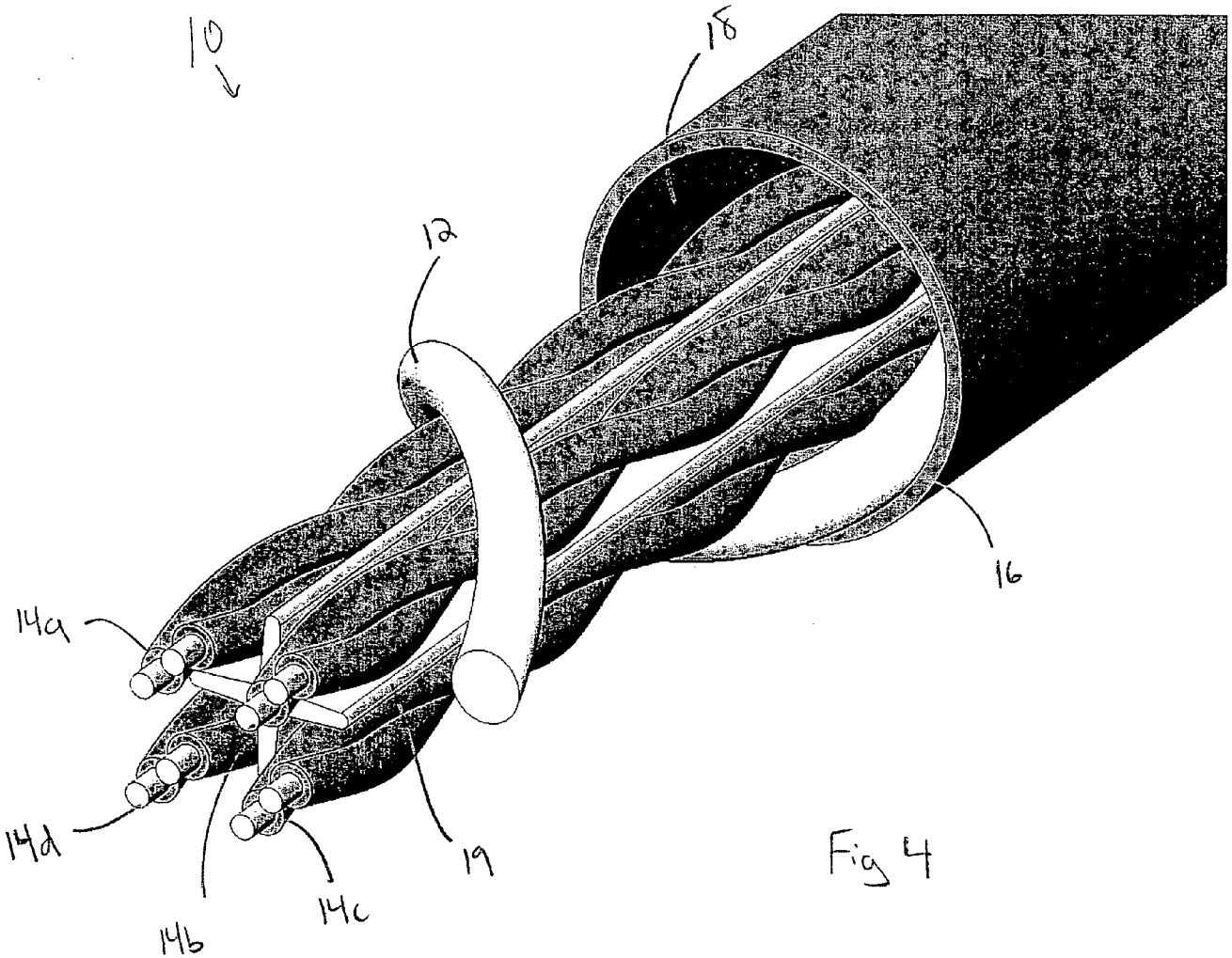
FIG. 4 is an isometric view of an unshielded twisted pair cable with cross filler from FIG. 3 with the portion of the jacket removed, in accordance with one embodiment of the present invention.

In another embodiment of the present invention, as illustrated in FIGS. 3 and 4, twisted pairs 14*a*-14*d* are disposed centrally within outer jacket 16 of cable 10, with an air spacing pocket 18 between the two. Additionally, twisted pairs 14*a*-14*d* are further separated from one another via a cross filler 19, such as an FEP cross filler used to reduce the amount of cross talk between the different twisted pairs 14 within cable 10 itself. Similar to FIGS. 1 and 2, air spacing pocket 18 is formed by filament 12 disposed helically around the center core of twisted pairs 14 and cross filler 19, holding jacket 16 at a predefined distance substantially equal to the thickness of filament 12.

In each of the embodiments shown in FIGS. 1-4 filament 12 is preferably of a thickness of anywhere between 0.030" diameter to 0.090" but may be thicker if desired to achieve the desired conductive and inductive coupling immunity.

As shown in cross section FIGS. 2 and 4, at any one point along cable 10, filament 12 is located in a single position between jacket 16 and twisted pairs 14, with the remainder of space being air spacing pocket 18. As illustrated in the longitudinal views in FIGS. 2 and 4, as filament 12 progresses along the length of cable 10, it spirals around twisted pairs 14*a*-14*d*, revolving at regular intervals. Filament 12 is preferably applied in a helical arrangement opposite the direction of the cable core lay (ie. the rotation of twisted pairs 14). Based on the material used for filament 12, as discussed in more detail below, the longitudinal spacing or interval between each complete revolution of filament 12 is preferably 0.75" or otherwise is preferably at most half the wavelength of the frequency range so as to alleviate the negative effects caused by the periodical filament application.

Regarding its construction, filament 12 is preferably made from either a fluoropolymer or PVC, however, the invention is not limited in this respect. Any material that is sufficiently fire resistant may be used. Examples of fluoropolymers that may be employed as filament 12 may include but are not limited to FEP, Cellular FEP, PE/FRPE (Fire Resistant Polyethylene) PE, or FRPE.

Figure 5:
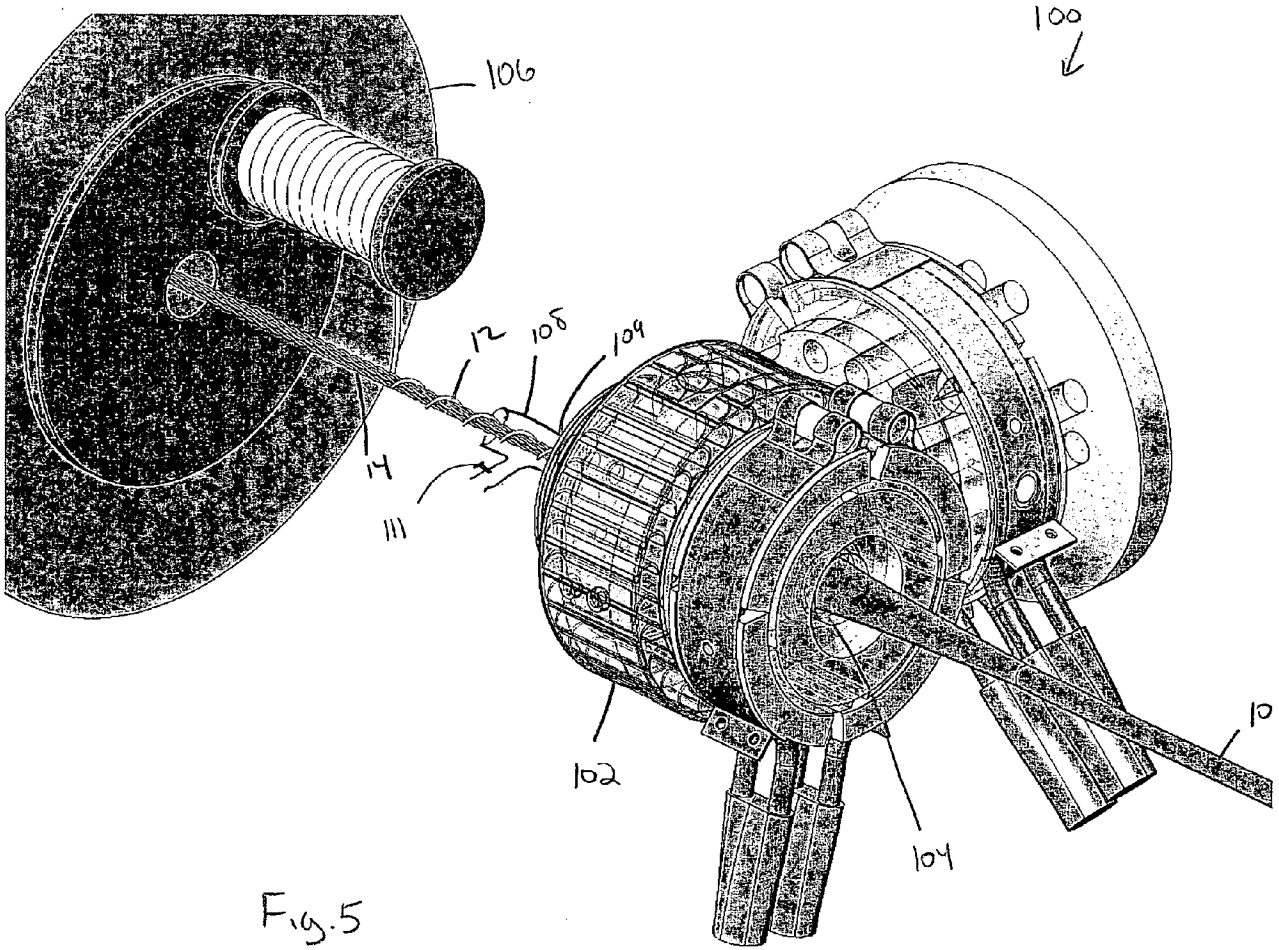
FIG. 5 is a diagram of a tube extrusion device for manufacturing the unshielded twisted pair cables as shown in FIGS. 1-4, in accordance with one embodiment of the present invention.

In one embodiment of the present invention, as illustrated in FIG. 5, a diagram of a cable manufacturing device 100 is shown. As illustrated in FIG. 3, device 100 comprises a tube extrusion head or cross head 102, having a tube extrusion die exit 104, and a binder head machine 106 located behind extrusion cross head 102. In this configuration device 10 is configured to deposit a pre-formed filament 12 onto twisted pairs 14 to form completed cable 10.

Device 100 is configured at a first entry end 109 to receive the cabled or assembled twisted pairs 14. Prior to being received at entry end 109, twisted pairs 14 enter and are pulled through binder head 106. Binder head 106, including reserved filament 12, continuously rotates in a 360 degree motion around twisted pairs 14, depositing filament 12 thereon.

As soon as filament 12 is deposited thereon, the combined twisted pairs 14 and filament 12 proceed into device 100, into tube extrusion head 102, where the jacket 16 material such as molten PVC is introduced. Tube extrusion die head 104 is configured to extrude PVC into a hollow tubular form for jacket 16 having an inner diameter that is preferably substantially equivalent to the diameter of the combined twisted pairs 14 plus an additional two times the diameter of filament 12, as shown in FIGS. 1-4. Tube extrusion head exit die 104 is of simple construction having a guider tip for passing the assembled twisted pairs 14 with the applied filament 12 and a die to form the cylindrical jacket 16 over the core (twisted pairs 14 and filament 12). Because twisted pairs 14 are surrounded by the helically fashioned filament 12, the jacket 16 remains at a constant distance away from twisted pairs 14, thus forming air spacing pocket 18, as illustrated in FIGS. 1-4.

In order to prevent sagging of the still warm jacket 16 into air spacing pocket 18, a positive air pressure is introduced into extrusion head 102, by air pressure control module 108. Module 108 is attached at the first entry end 109 of cross head 102 supplying a positive pressure thru the guider tip of extrusion head die exit 104 and subsequently inside jacket 16.

In this arrangement the accuracy of the process depends on the air flow control, the viscosity of jacket 16 during extrusion, and the air leakage behind air pressure control module 108 at the entry point 109 of twisted pairs 14 and filament 12 into tube extrusion head 102. In view of these factors, the process of pressurizing the jacket 16 during extrusion operates within a tolerance range. The air pressure from module 108 may be adjusted by way of a valve 111, which can be set to achieve the desired diameter for jacket 16. The extrusion rate may be varied between 25 fpm and 900 fpm depending on the extrusion line and binder head 106.

Optionally, a vacuum seizer positioned at the exit of the cross head creating a negative pressure outside of jacket 16 and changing jacket 16 from molten to solid state rapidly to determine its diameter would assist in determining the accuracy of the settings.

Figure 6:
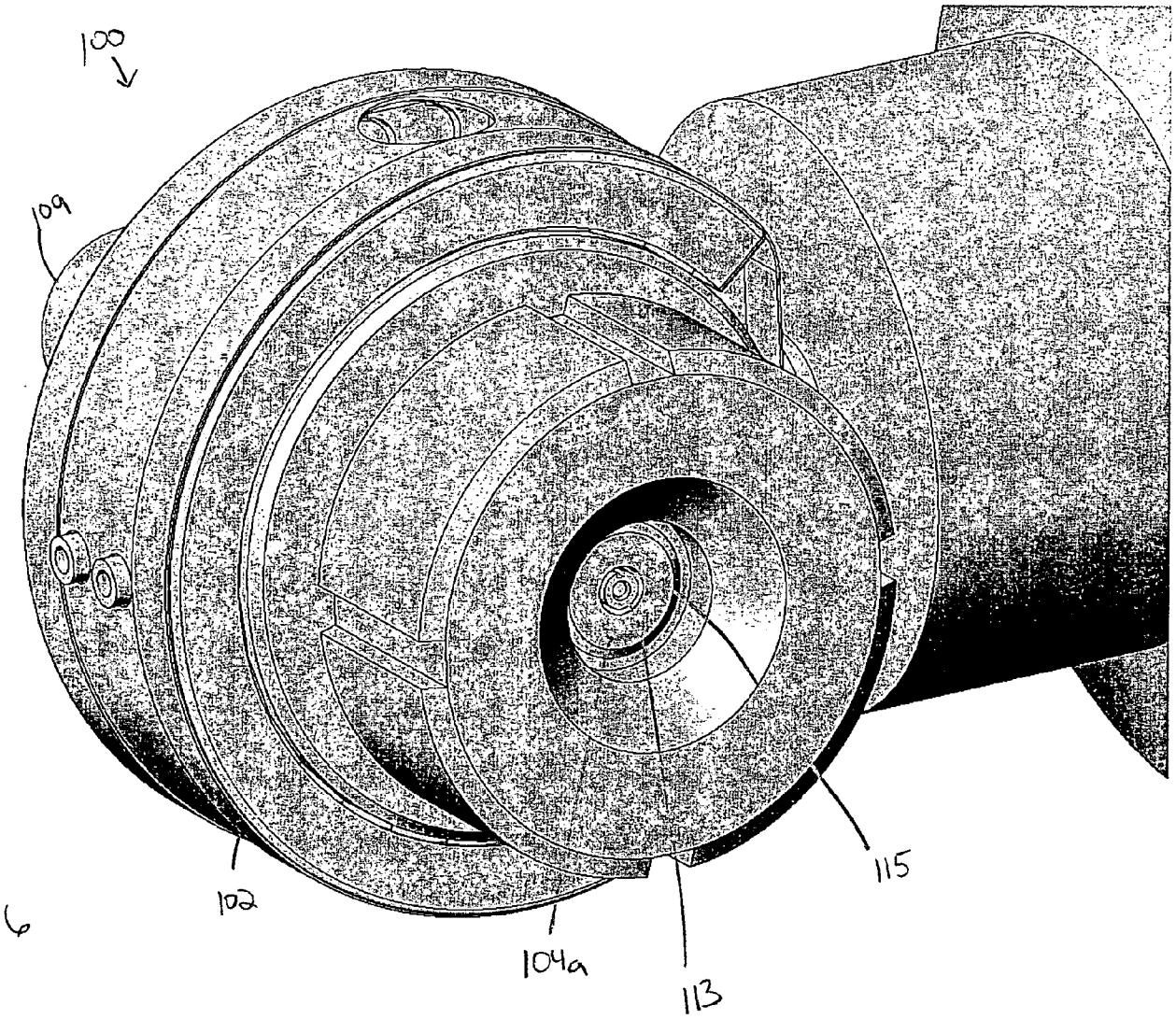
FIG. 6 is a diagram of a modified tube extrusion head exit die for the device as shown in FIG. 3, in accordance with one embodiment of the present invention.

In another embodiment of the present invention, device 100 can be modified to extrude filament 12 as a filament made from the same material as jacket 16, such as PVC. In such an instance binder head 106 is removed and a cross head 102 is fitted with a modified extrusion exit die 104*a* illustrated in FIG. 6, where a rotating guider tip 113 is introduced. Rotating guider tip 113 includes a notch 115, designed to create a spline (filament 12) inside the inner diameter of jacket 16, which is in fact a part of jacket 16. Filament 12 may be extruded to be in either hollow or solid arrangement to meet the desired specifications. The resulting cable 10 is similar to that shown in FIGS. 1-4, except that filament 12 and jacket 16 are formed as a single unit.

In the above described arrangement, an unshielded twisted pair cable 10 is formed having a central core of twisted pairs 14 and an outer jacket 16 where an air spacing gap 18 of substantially consistent size is maintained along the entire length of cable 10 by helically wound filament 12. Such an arrangement, not only reduces capacitive, inductive or conductive coupling between twisted pairs 14 and similar adjacent unshielded twisted pairs in another cable, but also provides a significant and continuous air spacing reducing the transmission line (twisted pairs 14) effective dielectric, hence reducing dielectric losses from mid to high frequency and reducing dissipation losses contribution at high frequency caused by the peripheral proximity of jacket 16 material to the core 14.

Furthermore, in contrast to prior art methods of reducing dielectric and dissipation losses related to insertion loss performance, the present arrangement improves high frequency insertion loss margin by approximately 7.5% relative to the striated inner jackets insertion loss margin from prior art when using a solid fluoropolymer filament 12 and approximately 5% relative to the striated inner jackets insertion loss margin from prior art when using a PVC filament 12. This is a significant increase considering that typical cables in the industry have and average insertion loss margin of 3%. Additionally, filament 12 is relatively small, lightweight and low cost, and thus does not add significant cost to manufacturing, it does not reduce mechanical properties of cable 10 nor does it significantly decrease its ability to pass fire safety standards such as NFPA 262.

Figure 7:
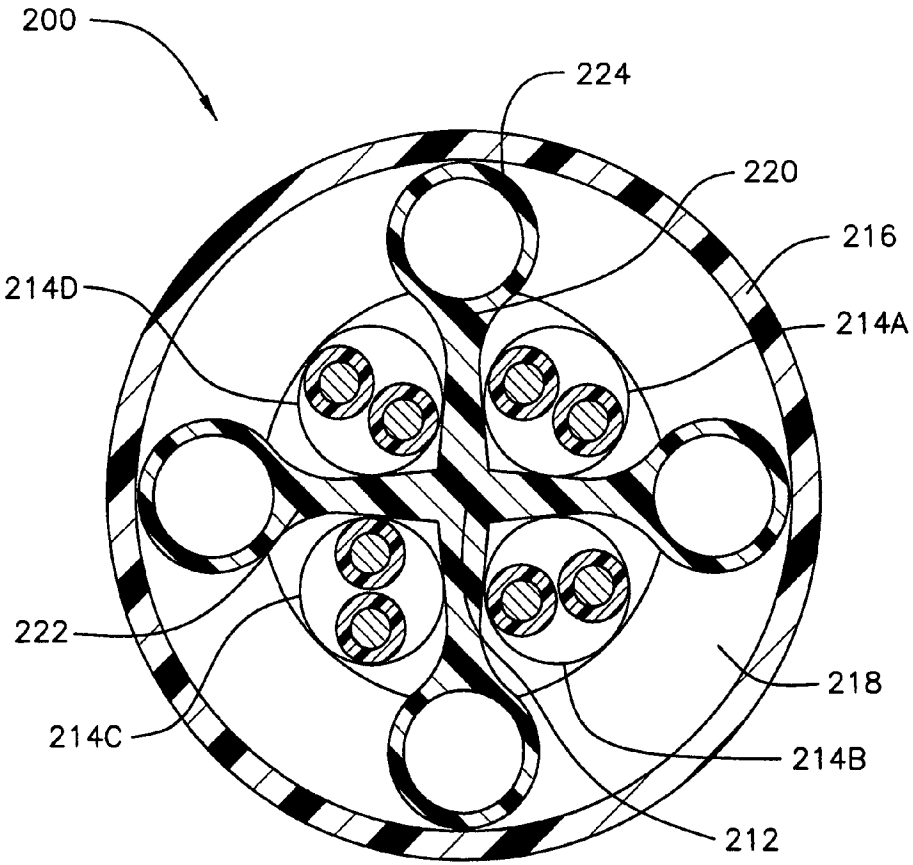
FIG. 7 is a cross sectional view of the unshielded twisted pair cable with a bumpered cross filler, in accordance with another embodiment of the present invention.
Figure 1:
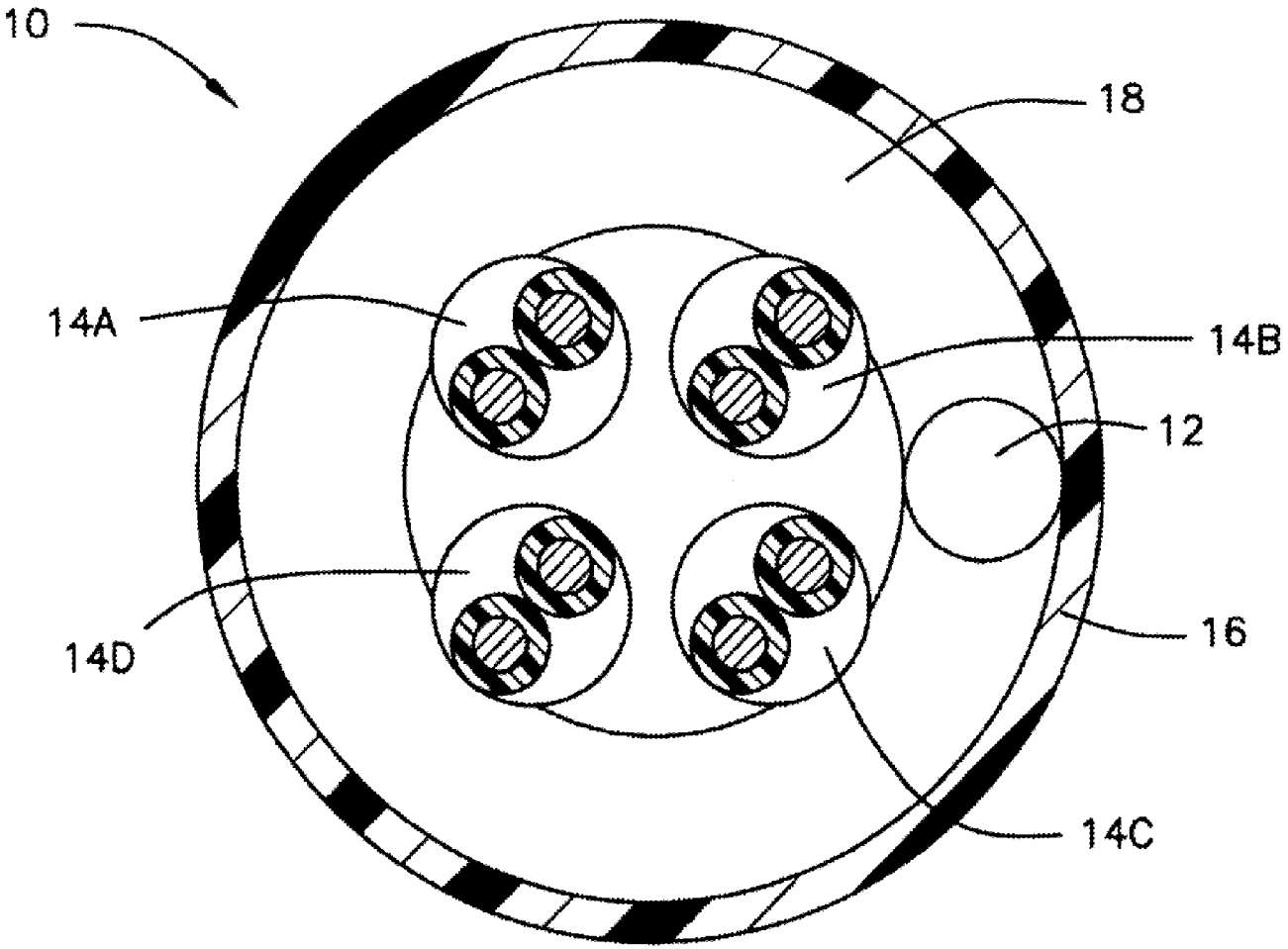
Figure 2:
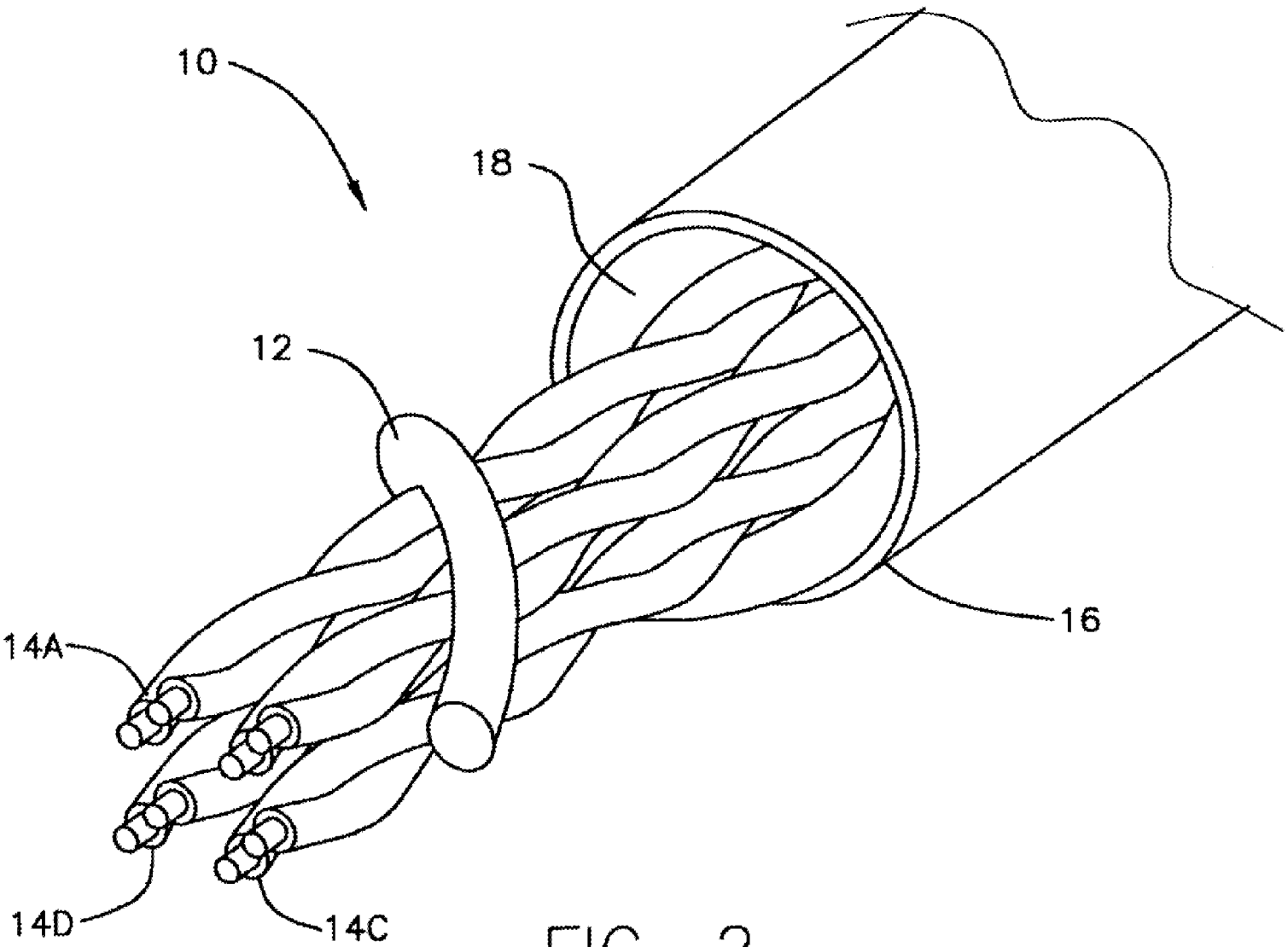
Figure 3:
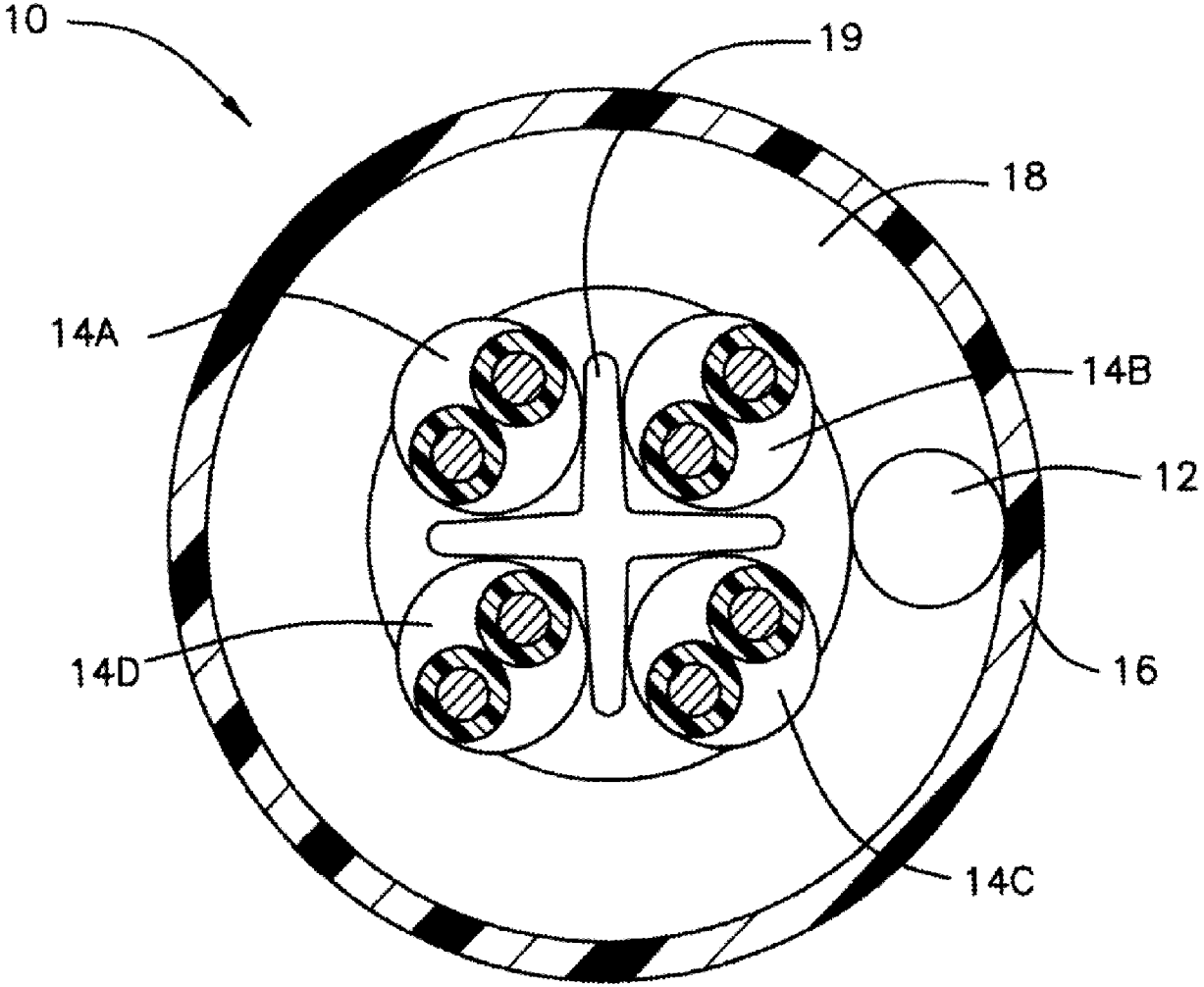
Figure 4:
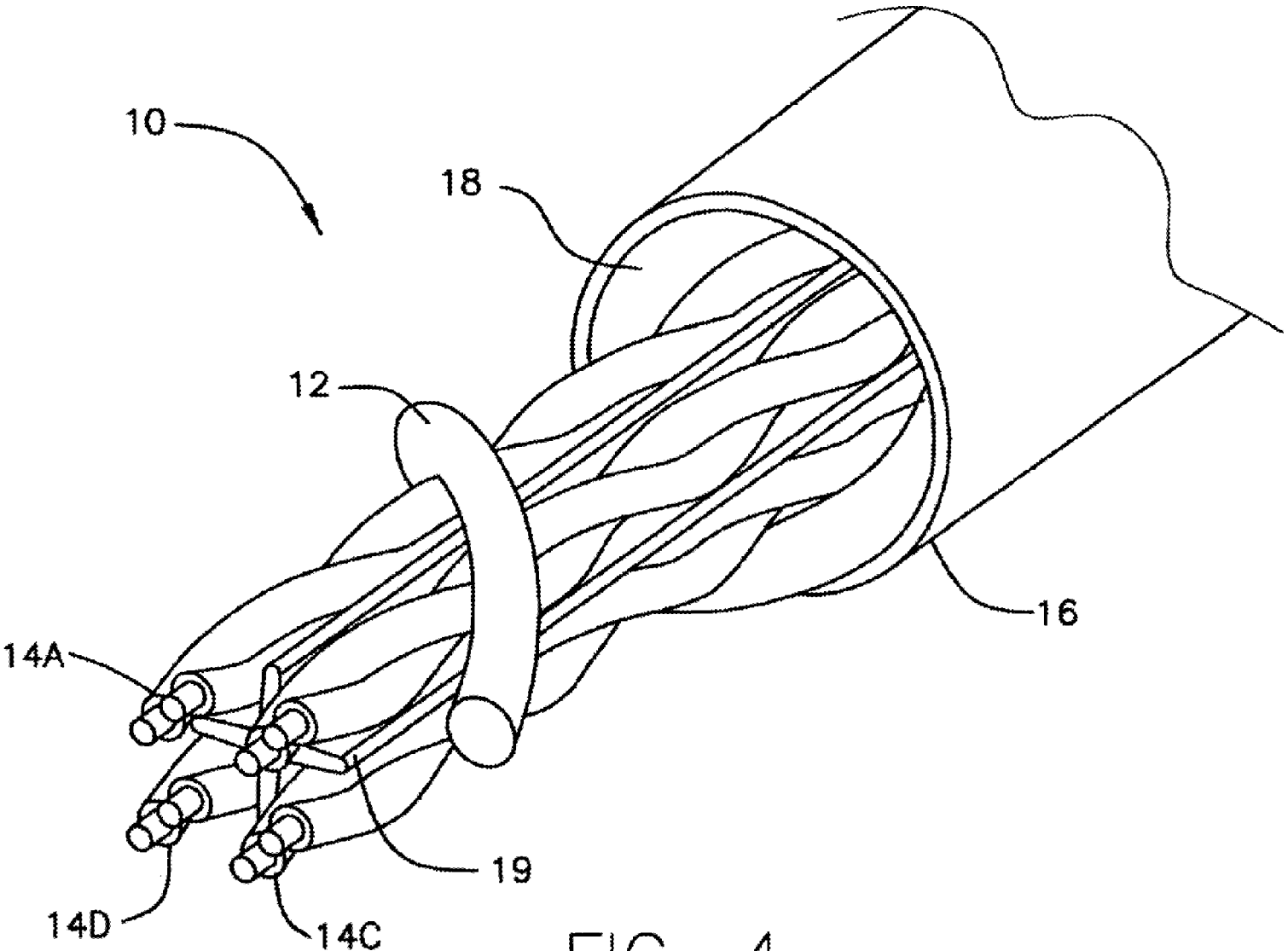
Figure 5:
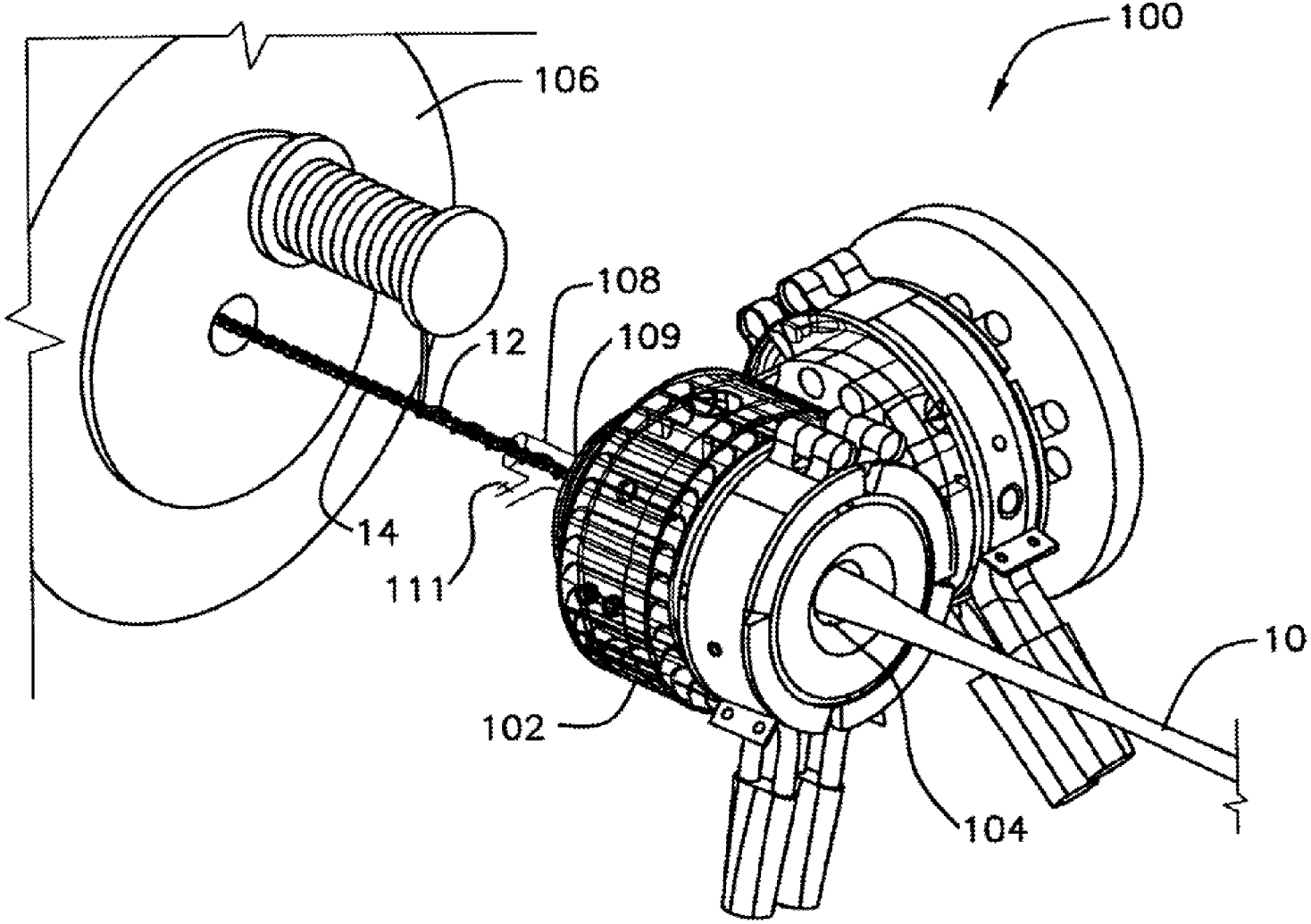
Figure 6:
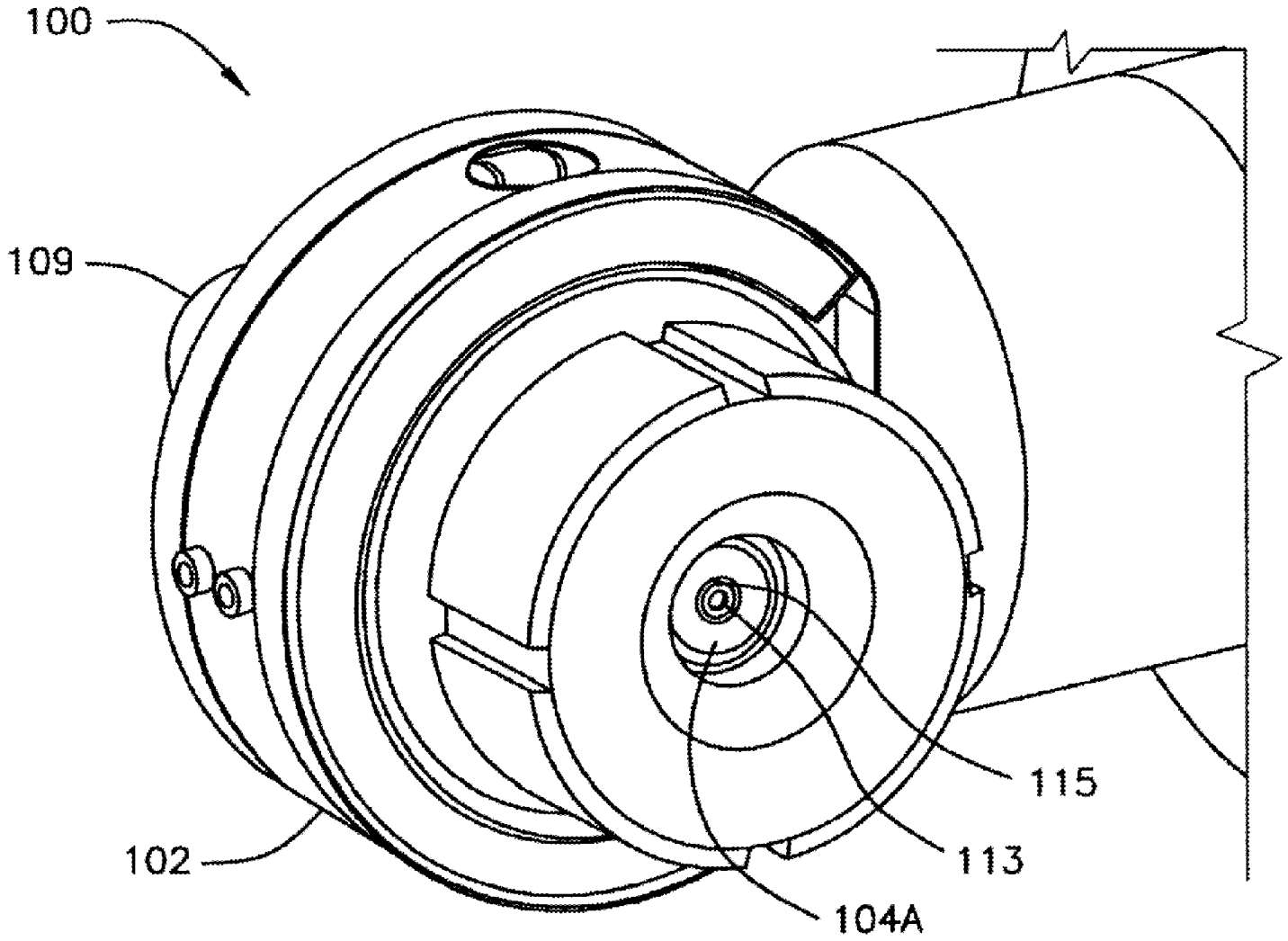
Figure 7:
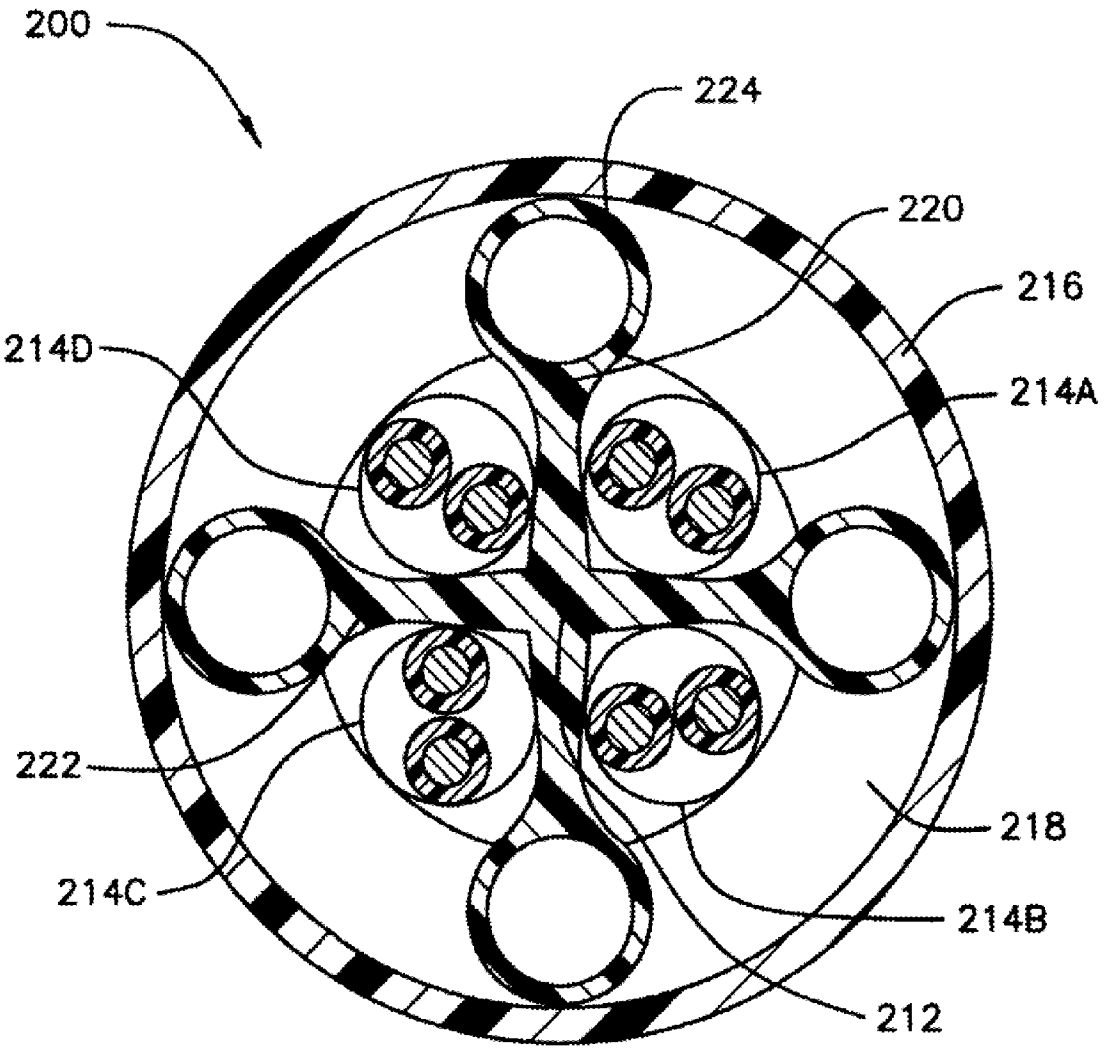

In another embodiment of the present invention as illustrated in FIG. 7, an unshielded twisted pair cable 200 is shown having twisted pairs 214*a* . . . 214*n*, jacket 216, and bumpered cross filler 212. Similar to cable 10, cable 200 maintains like unshielded twisted pairs 214 and a similar jacket 216. The same materials outlined above with relation to cable 10 are also applicable to the like components of cable 200. However, unlike cable 10, cable 200 does not have filament 12, but instead has bumpered cross filler 212.

In the arrangement shown in FIG. 7, bumpered cross filler 212 is configured to divide the inside of cable 200 into four separate sections such that twisted pairs 214*a* through 214*d* are each separated from one another. Such a configuration may be used to reduce signal crosstalk between each of the twisted pairs 214 within cable 200. Although the example is shown with four twisted pairs 214, it is understood that this is by way of example only at that any number of twisted pairs in a similar cable 200 is also within the contemplation of the present invention.

As illustrated in FIG. 7, similar to cable 10, cable 200 also maintains an air spacing gap 218 between the inside of jacket 216 and the outer edges of twisted pairs 214. This configuration is held along the entire length of cable 200. Thus, because of air spacing gap 218, there is no contact between jacket 216 and twisted pairs 214 resulting in the similar increases in insertion loss margins as those outline above with cable 10.

In this embodiment, air spacing gap 218 is formed by bumpered cross filler 212. Filler 212 is typically is constructed from a low loss material such as FEP, but other materials such as PE and FRPE may also be used.

Bumpered cross filler 212 is preferably composed of a vertical central axis 220, a horizontal central axis 222 and bumper or spacing elements 224*a* . . . 224*d*. Vertical and horizontal central axes 220 and 222 are configured to divide twisted pairs 214*a* . . . 214*d* from one another within cable 200. Hollow or solid spacing elements 224 are preferably fashioned as bulbous circular or otherwise ovular tube like bumpers that form a spatial barrier between jacket 216 and twisted pairs 214, however the invention is not limited in this respect. For example, additional shapes for bumper elements 224 may include outward facing triangle or wedge shapes or other such hollow or solid geometric shapes of increased volume.

Bumpered cross filler 212 is incorporated into cable 200 during a cabling step prior to extrusion of jacket 16, where twisted pairs 214 are each placed in their respective quadrant of filler 212 forming the core, which is then fed through device 100 described above, minus the filament 12 laying binder head 106 which is not required to produce cable 200 as shown in FIG. 7.

Spacing elements 224 of bumpered cross filler 212 may either be hollow or solid, but in either arrangement they do not add significant mass to the overall filler 212 and cable 200 structures. Thus, cable 200 provides a similar means of generating air spacing gap 218 similar to air spacing gap 18 described above with cable 10 to reduce capacitive and inductive coupling between twisted pairs 214 and similar unshielded twisted pairs in adjacent cables. This arrangement also provides a significant and continuous air spacing 218 reducing the transmission line (twisted pairs 214) effective dielectric, hence reducing dielectric losses from mid to high frequency and reducing dissipation losses contribution at high frequency caused by the peripheral proximity of jacket 216 material to core 214. Additionally, bumpered cross filler 212 provides spacing between twisted pairs 214*a* through 214*d* thus also reducing internal crosstalk within cable 200 as well.

Using the arrangement as illustrated in FIG. 7 with a solid FEP bumpered cross filler 212 the insertion loss margin is improved by 3% relative to striated inner jackets insertion loss margin.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. An unshielded twisted pair cable, said cable comprising:

a plurality of unshielded twisted pairs;

a filament, helically wound around said plurality of unshielded twisted pairs;

a jacket encasing said plurality of unshielded twisted pairs and said filament; and a gap, being formed by and being substantially the same thickness as the thickness of said filament, around the entire circumference of said cable, said gap being between said jacket and said plurality of unshielded twisted pairs such that said gap formed by said filament prevents said jacket from contacting said plurality of unshielded twisted pairs so as to reduce dielectric loss in signals carried in said plurality of unshielded twisted pairs caused by said jacket.

2. The cable as claimed in claim 1, wherein said plurality of unshielded twisted pairs may include any one of copper conductor pairs with FEP (Fluorinated Ethylene Propylene) insulation, copper conductors with MFA (Polytetrafluoroethylene-Perfluoromethylvinylether) insulation, stranded conductors made of tined plated copper, silver plated or bare copper strands with PE (polyethylene) insulation, copper conductors with PE insulation, copper conductors with cellular PE or FEP insulation, or copper conductors with cellular PE or FEP insulation and an outer PE or FEP skin (solid layer).

3. The cable as claimed in claim 1, wherein said filament is a fluoropolymer.

4. The cable as claimed in claim 3, wherein said fluoropolymer is any one of FEP, Cellular FEP, PE/FRPE (Fire Resistant Polyethylene) PE, or FRPE.

5. The cable as claimed in claim 1, wherein said filament is made from PVC (Polyvinyl Chloride).

6. The cable as claimed in claim 1, wherein said filament and said jacket are constructed as a single unit.

7. The cable as claimed in claim 1, wherein said filament is of a thickness (diameter) between 0.030" and 0.090".

8. The cable as claimed in claim 1, wherein said filament is helically wound at an interval of one complete revolution around said plurality of unshielded twisted pairs substantially every 0.75".

9. The cable as claimed in claim 1, wherein said filament is helically wound at an interval of at most half the wavelength of the frequency range of the signals being sent on said plurality of unshielded twisted pairs.

10. The cable as claimed in claim 1, wherein said filament is helically wound in a direction opposite the direction of the twist in said plurality of unshielded twisted pairs.

11. The cable as claimed in claim 1, wherein said jacket is constructed of any one of PVC (Polyvinyl chloride), low smoke zero halogen PVC, FEP, PVDF (Polyvinylidene Fluoride), PE or ECTFE (Poly (Ethylene Chlorotrifluoroethylene)).

12. The cable as claimed in claim 1, further comprising a cross filler, said cross filler disposed substantially in the center of said cable having a plurality of cells, and arranged to hold said plurality of unshielded twisted pairs in said cells to separate the pairs from one another.

* * * * *

UNITED STATES PATENT AND TRADEMARK OFFICE

CERTIFICATE OF CORRECTION

PATENT NO. : 7,390,971 B2
APPLICATION NO. : 11/119331
DATED : June 24, 2008
INVENTOR(S) : Jean et al.

It is certified that error appears in the above-identified patent and that said Letters Patent is hereby corrected as shown below:

Delete Title page illustrating a figure(s), and substitute therefor, new Title page illustrating a figure(s). (attached)

Delete drawing sheets 1-7, consisting of figures 1-7, and substitute therefor drawing sheets 1-7, consisting of Figures 1-7, as shown on the attached sheet.

Signed and Sealed this

Twenty-sixth Day of August, 2008

JON W. DUDAS
*Director of the United States Patent and Trademark Office*

(12) United States Patent
Jean et al.

(10) Patent No.: US 7,390,971 B2
(45) Date of Patent: Jun. 24, 2008

(54) UNSHEILDED TWISTED PAIR CABLE AND METHOD FOR MANUFACTURING THE SAME

(75) Inventors: Frédéric Jean, Litiz, PA (US); Donald Stevens, Lancaster, PA (US)

(73) Assignee: Nexans (FR)

( * ) Notice: Subject to any disclaimer, the term of this patent is extended or adjusted under 35 U.S.C. 154(b) by 0 days.

(21) Appl. No.: 11/119,331

(22) Filed: Apr. 29, 2005

(65) Prior Publication Data

US 2006/0243477 A1 Nov. 2, 2006

(51) Int. Cl.
*H01B 7/00* (2006.01)

(52) U.S. Cl. ..... 174/113 AS; 174/113 R; 174/113 C

(58) Field of Classification Search ..... 174/113 AS, 174/113 C, 113 R

See application file for complete search history.

(56) References Cited

U.S. PATENT DOCUMENTS

| | | | | |
|---|---|---|---|---|
| 5,796,046 | A | 8/1998 | Newmoyer et al. | 174/113 |
| 5,922,155 | A | 7/1999 | Clouet et al. | 156/51 |
| 6,310,295 | B1 * | 10/2001 | Deapard | 174/113 R |
| 6,596,944 | B1 | 7/2003 | Clark et al. | 174/113 |
| 6,826,338 | B2 * | 11/2004 | Matsuyama | 385/110 |
| 2003/0132021 | A1 | 7/2003 | Gareis | 174/113 |
| 2004/0124000 | A1 | 7/2004 | Stipes et al. | 174/113 |
| 2005/0006132 | A1 | 1/2005 | Clark | 174/113 |
| 2005/0092514 | A1 | 5/2005 | Kenny et al. | 174/113 |
| 2005/0092515 | A1 | 5/2005 | Kenny et al. | 174/113 |
| 2005/0279528 | A1 | 12/2005 | Kenny et al. | 174/113 |
| 2006/0237217 | A1 | 10/2006 | Glew | 174/113 |

FOREIGN PATENT DOCUMENTS

| | | | |
|---|---|---|---|
| EP | 0688024 | 12/1995 | |
| EP | 1107262 | 6/2001 | 11/8 |
| EP | 1162632 | 12/2001 | 11/4 |
| JP | 2003323821 | 11/2003 | 11/4 |
| JP | 2003346569 | 12/2003 | 11/8 |
| WO | WO01/29848 | 4/2001 | 7/18 |
| WO | 2006050612 | 11/2005 | |
| WO | 2006065414 | 11/2005 | |

* cited by examiner

*Primary Examiner*—Jinhee J. Lee
(74) *Attorney, Agent, or Firm*—Sofer & Haran, LLP

(57) ABSTRACT

An unshielded twisted pair cable includes a plurality of unshielded twisted pairs, a filament helically wound around the plurality of unshielded twisted pairs and a jacket encasing the plurality of unshielded twisted pairs and the filament. A gap, between the jacket and the plurality of unshielded twisted pairs, is formed by and is substantially the same thickness as the thickness of the filament.

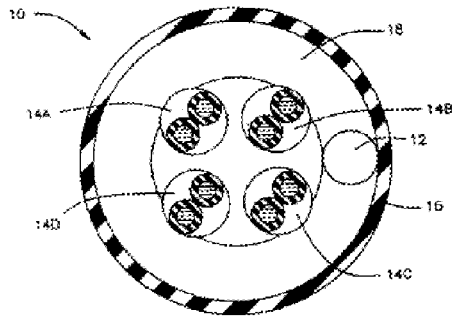

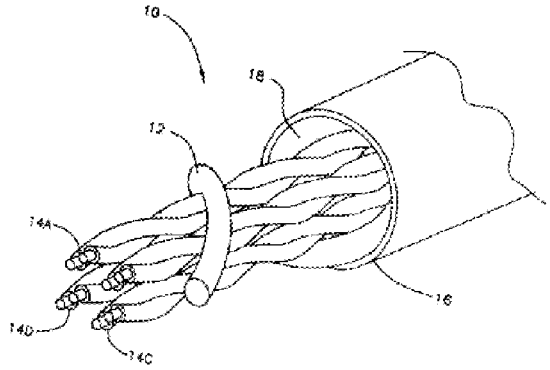

12 Claims, 7 Drawing Sheets